United States Patent [19]

Lau

[11] Patent Number: 4,843,278

[45] Date of Patent: Jun. 27, 1989

[54] IN-LINE GUN SYSTEM FOR A COLOR PICTURE TUBE

[75] Inventor: Bernhard Lau, Elchingen, Fed. Rep. of Germany

[73] Assignee: Nokia Graetz GmbH, Pforzheim, Fed. Rep. of Germany

[21] Appl. No.: 16,351

[22] Filed: Feb. 19, 1987

[30] Foreign Application Priority Data

Feb. 19, 1986 [DE] Fed. Rep. of Germany ..... 3605247

[51] Int. Cl.[4] ..... H01J 29/56; H01J 29/62

[52] U.S. Cl. ..... 313/414; 313/409

[58] Field of Search ..... 313/409, 412, 414

[56] References Cited

U.S. PATENT DOCUMENTS

| | | | |
|---|---|---|---|
| 2,898,493 | 8/1959 | Burdick | 313/412 |
| 4,377,767 | 3/1983 | Kornaker | 313/409 X |
| 4,412,149 | 10/1983 | Say | 313/409 X |
| 4,517,488 | 5/1985 | Say | 313/414 |

FOREIGN PATENT DOCUMENTS

| | | | |
|---|---|---|---|
| 216342 | 12/1983 | Japan | 313/409 |
| 189144 | 9/1985 | Japan | 313/460 |

*Primary Examiner*—Kenneth Wieder

*Attorney, Agent, or Firm*—Peter C. Van Der Sluys

[57] ABSTRACT

In a color picture tube with an in-line gun system elliptic beam-spot distortion caused by the deflection field is compensated for by pairs of plates in at least one focus electrode. The plates project into the apertures for the electron beams and are located at a distance from the bottom of the focus electrode.

4 Claims, 2 Drawing Sheets

IN-LINE GUN SYSTEM FOR A COLOR PICTURE TUBE

BACKGROUND OF THE INVENTION

The present invention relates to a color picture tube.

U.S. Pat. No. 4,086,513 discloses a color picture tube with an in-line gun system in which parallel plates are attached to a focus electrode on both sides of the beam plane. This parallel pair of plates is directed towards the screen and serves to compensate the elliptic distortion of the beam spots by the deflection field, such distorted beam spots reducing the sharpness of the image reproduced. The pair of plates is attached to the focus electrode nearest to the screen. Alternatively, plates can be attached to a focus electrode near the first-mentioned focus electrode on both sides of the beams directed towards the last focus electrode. These plates are mounted at an angular distance of 90 degrees from the first-mentioned parallel pair of plates.

SUMMARY OF THE INVENTION

It is one object of the invention to provide a color picture tube with an in-line gun system causing an improvement in the compensation of the distortion of beam spots.

BRIEF DESCRIPTION OF THE DRAWING

The embodiments of the invention will now be explained with reference to the accompanying drawings, in which.

DETAILED DESCRIPTION

Figure 1:
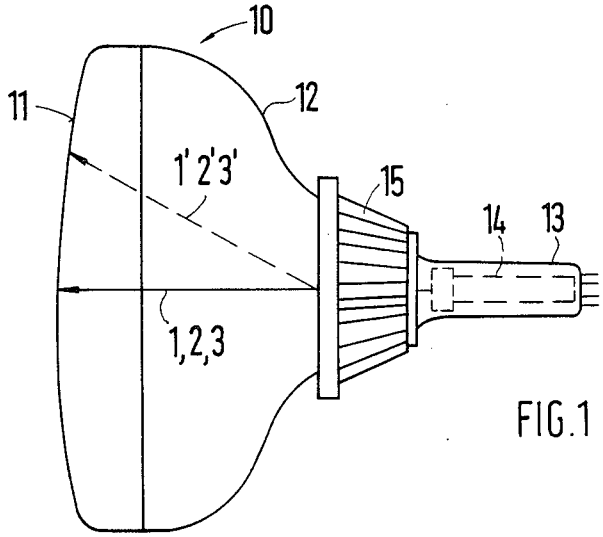
FIG. 1 is a side view of a color picture tube.

FIG. 1 shows a color picture 10 tube comprising a screen 11, a funnel 12, and a neck 13. In the funnel 13, an in-line gun system 14 (drawn in broken lines) is located producing three electron beams 1, 2, 3, which are swept across the screen 11 (1', 2', 3'). A magnetic deflection system 15 is located at the transition from the neck 13 to the funnel 12.

Figure 2:
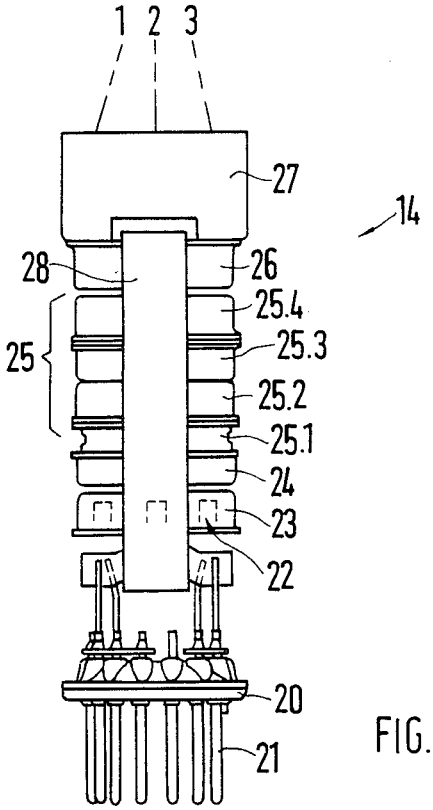
FIG. 2 is a side view of an in-line gun system.

FIG. 2 is a side view of the in-line gun system 14. It has a molded glass disk 20 with sealed in contact pins 21. The contact pins 21 are conductively connected (not shown) to the electrodes of the in-line gun system 14. The contact pins are followed by grid electrodes 23, 24, focus electrodes 25, 26 and a convergence cup 27. Inside the grid electrode 23, cathodes 22 are arranged which are shown only schematically in broken lines. The first grid electrode 23 is also called control grid, and the second grid electrode 24 is also called screen grid. The cathode together with the control grid and the screen grid is called triode lens. The focus electrodes 25, 26 form a focusing lens. The individual parts of the in-line electrode gun 14 are held together by two glass beads 28.

The focus electrode 25 consists of 4 cup-shaped electrodes 25.1 to 25.4, of which two each are joined together at their free edges and thus form a cup-shaped electrode. In all electrodes of the in-line gun system 14, there are three coplanar aperatures through which the electron beams 1, 2, 3 produced by the three cathodes 22 can pass. Three beams 1, 2, 3 are thus produced in the in-line gun system which strike the Luminescent Layer of the screen 11. In order to change the shape of the beam spot to obtain improved sharpness of the reproduced image, a suitable astigmatism is imparted to the in-line gun system. This effect is obtained by a slit diaphragm in the grid electrode 24 of the triode lens and by plates on both sides of the beam plane or on both sides of the beams in the focus electrode(s).

It is necessary to divide the astigmatism of the beam system between the triode lens and the focusing lens. The triode lens forms a smallest beam section which—in analogy to optics—is imaged on the screen with the following lenses. The astigmatic construction of this triode lens also leads to an astigmatism of the aperture angle of the bundle of rays emerging from the triode lens. A larger aperture angle facilitates defocusing of the image of the smallest beam section and the viewer of the color picture tube focuses on the plane with the larger aperture angle, i.e., the vertical and not the horizontal focal line of the astigmatic beam section of the triode lens is imaged on the screen. On the other hand, the aperture angle must not become too large, because then the bundle of rays moves to the bordering region of the imaging lenses. The large spherical aberration of these rather small electrostatic lenses does not permit a sharp image. Therefore, a sufficient astigmatic deformation of the bundle of rays is possible only if it is partly effected in the last focusing lens of the beam system where the aperture angle of the bundle of rays is no longer influenced.

Figure 3:
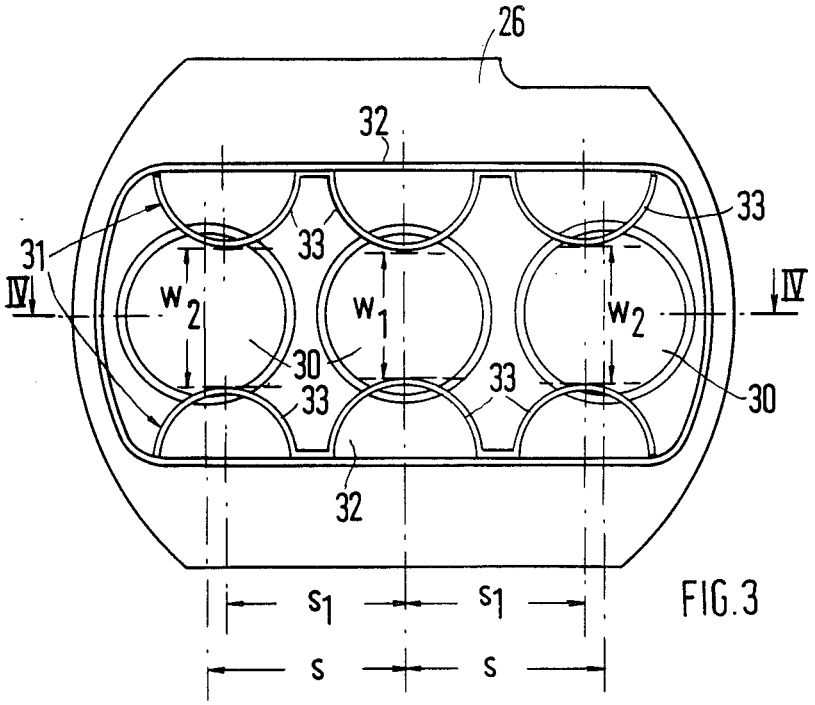
FIG. 3 is a top view of a focus electrode.

FIG. 3 is a top view of the cup-shaped focus electrode 26. In the bottom of the focus electrode 26, there are three coplanar apertures 30 for the passage of the electron beams 1, 2, and 3, respectively. At the walls 32 of the focus electrode 26 two plates 31 are attached opposite each other, each of which has three curved portions 33. These curved portions 33 project into the apertures 30. The plates 31 can also consist of three individual curved portions 33. In the embodiment shown in FIG. 3, the curved shape of the portions 33 corresponds to an arc of a circle. The shape of the portions 33 can also be elliptic or parabolic or have a similarly curved shape. The distance $w_1$ between the opposite vertices of the portions 33 projecting into the central aperture is smaller than the distance $w_2$ between the opposite vertices of the portions 33 for the outer apertures 30. Furthermore, the vertices of the portions 33 for the outer apertures are not on the center line of the outer apertures 30. In order to make this clear, the distance of the central points of the apertures 30 from each other is designated by the letter S in FIG. 3. The distance of the vertices of the outer portions 33 from the central vertex in the plate 31 is designated by $s_1$. It is clear that the value $s_1$ is smaller than the value S. This makes it possible to influence the angle the outer electron beams 1, 3 make with the central electron beam 2 to achieve static convergence.

Figure 4:
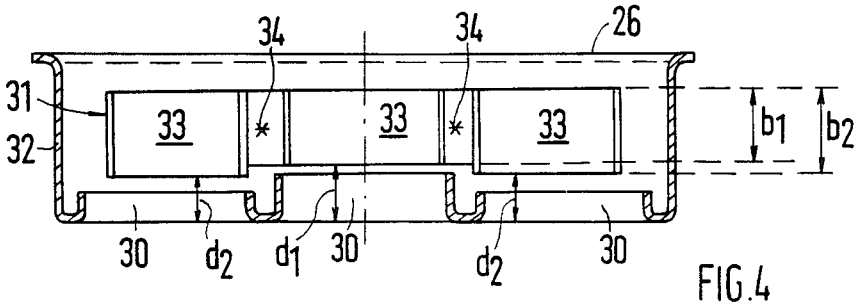
FIG. 4 is a section through the focus electrode of FIG. 3 along line IV—IV.

FIG. 4 is a section of the focus electrode 26 along line IV—IV of FIG. 3. The apertures 30 in the bottom of the focus electrode 26 have burred holes whose height for the individual apertures can be different. The plates 31, which may be attached to the wall 32 of the focus electrode 26 by weld spots 34, are arranged in a defined spaced-apart relation with respect to the inner edge of the burred holes. The distance from the bottom of the focus electrode 26 to the lower edge of the portions 33 of the plates 31 projecting into the apertures 30 is designated by the letter d. The distance $d_1$ for the portion 33 projecting into the central aperture 30 is larger than the corresponding distances $d_2$ of the outer portions 33 from the bottom of the focus electrode 26. By varying the distance d, the astigmatism of the focus electrode can be influenced. It is thus possible to choose the distances d of the various portions 33 from the bottom of the focus electrode individually in order to optimize the adjustment of the astigmatism individually for each electron beam. The height of the portions 33 of the plates 31 is designated by the letter b. By varying this height b, the astigmatism of the focus electrode can also be changed. Here, too, it is possible to determine the height b individually for each portion 33 in order to optimize the adjustment of the astigmatism for each electron beam. In the embodiment shown in FIG. 4, the height $b_2$ of the outer portions 33 is larger than the height b1 of the inside portion 33.

The plates 31 described above do not only influence the astigmatism of the focusing lens, but also the other lens aberrations, i.e., the spherical aberration and the further higher-order aberrations. This influence is different for each of the embodiments described above. The higher-order aberrations can be seen mainly at the edge of the picture. They can be minimized by a suitable combination of the plates at the electrodes of the focusing length. It is possible, for example, to distribute the correction to the two focus electrodes or to impress too strong an astigmatism on one of the two focus electrodes, with partial compensation at the other focus electrode.

By the use of the plates 31 described above, it is possible to adjust the astigmatism very finely, thus producing an improved sharpness across the entire screen. By the fine adjustment of the static convergence, which is possible as well, the sharpness can also be improved. Furthermore, the dynamic convergence is improved, too.

What is claimed is:

1. A color picture tube, comprising:

a screen;

a funnel;

a neck;

a deflection system mounted on said neck at the transition of said neck to said funnel and which contains an inline gun system comprising cathodes and grid and focus electrodes, said focus electrodes having separate apertures each with a continuous edge for guiding electron beams to said screen, at least one of said focus electrodes having plates attached thereto which are located on both sides of the electron beams and are disposed on the screen side of said at least one said focus electrodes; said plates having curved portions which project into said apertures and are arranged in a spaced relationship from the screen side of the aperture of the respective focus electrode; and one of the grid electrodes contains a slit diaphragm.

2. A color picture tube as claimed in claim 1, wherein: vertices of said curved portions of said plates for the outer electron beams are located beside the center lines of said apertures for these electron beams in the focus electrode.

3. A color picture tube as claimed in claim 1, wherein: the distances (w) between opposite ones of said plates are different for the different electron beams.

4. A color picture tube as claimed in claim 1, wherein: the distances between said plates and the bottom of the respective focus electrode differ for the individual electron beams.

* * * * *